US010462849B1

(12) United States Patent
Reichert

(10) Patent No.: US 10,462,849 B1
(45) Date of Patent: Oct. 29, 2019

(54) COIL FOR PERSONAL VAPORIZER

(71) Applicant: Matthew Reichert, West Chester, PA (US)

(72) Inventor: Matthew Reichert, West Chester, PA (US)

( * ) Notice: Subject to any disclaimer, the term of this patent is extended or adjusted under 35 U.S.C. 154(b) by 211 days.

(21) Appl. No.: 15/592,042

(22) Filed: May 10, 2017

Related U.S. Application Data

(60) Provisional application No. 62/334,488, filed on May 11, 2016.

(51) Int. Cl.
*H05B 3/26* (2006.01)
*A24F 47/00* (2006.01)

(52) U.S. Cl.
CPC ..... *H05B 3/262* (2013.01); *A24F 47/008* (2013.01); *H05B 2203/021* (2013.01)

(58) Field of Classification Search
CPC .. H05B 3/262; H05B 2203/021; A24F 47/008
USPC ..... 392/394
See application file for complete search history.

(56) References Cited

U.S. PATENT DOCUMENTS

2014/0041655 A1* 2/2014 Barron ..... A61M 11/042 128/202.21
2015/0136158 A1* 5/2015 Stevens ..... A24F 47/008 131/329
2015/0257443 A1* 9/2015 Rado ..... A24F 47/00 392/390
2016/0219937 A1* 8/2016 Rado ..... A24F 47/008
2016/0235124 A1* 8/2016 Krietzman ..... A24F 47/008
2016/0353799 A1* 12/2016 Otto ..... A24F 47/008
2017/0055579 A1* 3/2017 Kuna ..... A24F 47/008
2017/0188628 A1* 7/2017 Montgomery ..... A24F 47/008
2017/0224013 A1* 8/2017 Huang ..... A24F 47/008

* cited by examiner

*Primary Examiner* — William M McCalister
(74) *Attorney, Agent, or Firm* — Robert J. Yarbrough

(57) ABSTRACT

A coil for a personal vaporizer includes a cup. The heating element for the cup is disposed outside of the cup interior volume and selectably heats the outside surface of the cup through resistance heating. The quartz glass composing the cup conducts heat from the heating element to a concentrate within the cup to boil the concentrate. The cup may be contained within a housing. The housing may retain the cup and may hold the heating element in direct physical contact with the cup.

13 Claims, 13 Drawing Sheets

COIL FOR PERSONAL VAPORIZER

I. RELATED APPLICATIONS

This application is entitled to priority from U.S. provisional patent application 62/334,488 by Matthew Reichert filed May 11, 2016, which application is incorporated by reference as if set forth in full herein.

II. BACKGROUND OF THE INVENTION

A. Field of the Invention

The Invention is a coil for a personal vaporizer for use in vaping. The coil contains and heats 'concentrate,' as defined below, so that the concentrate will boil to vapor. The coil of the Invention is longer lasting, more resistant to damage and easier to clean than the prior art coils. The Invention is also a heating element for use in a vaping coil and a personal vaporizer utilizing the coil of the Invention.

B. Statement of the Related Art

A 'personal vaporizer,' is a handheld electronic device that vaporizes a small amount of a fluid by boiling the fluid. The resulting vapor may condense to an aerosol within the personal vaporizer. A user then inhales the aerosol and vapor. Inhaling the aerosol and vapor produced by the personal vaporizer is referred to as "vaping," which is the gerund form of the infinitive verb 'to vape.' The fluid that is vaporized in the personal vaporizer is known as 'concentrate,' 'extract,' or 'e-liquid.' For the purposes of this document, including the claims, any fluid that a person may wish to vape is referred to as 'concentrate.'

The use of personal vaporizers, particularly to deliver nicotine, is enjoying exponential growth. Users generally view personal vaporizers as a safer alternative to tobacco cigarettes. The heating element of the personal vaporizer operates at a much lower temperature than the burning tip of a tobacco cigarette and so does not generate the products of combustion of a tobacco cigarette. In addition and unlike a tobacco cigarette, the contents of the vaping concentrate can be closely controlled to eliminate unwanted chemical compounds from the inhaled aerosol or vapor.

A personal vaporizer includes a 'coil.' As used in this document, the term 'coil' means an apparatus that is configured to retain the concentrate and to heat the concentrate to its boiling point. A current art coil for a personal vaporizer may include two quartz glass rods disposed within a ceramic cup. Resistance wires are wrapped about the two quartz glass rods. When a switch is closed, electrical current flows from a battery through the resistance wires, heating the wires, the quartz glass rods and the concentrate in the ceramic cup. The concentrate in the ceramic cup is in direct contact with the resistance wire and the quartz glass rods. The heating element heats the concentrate to its boiling point. The boiling concentrate produces the vapor, which then condenses to the aerosol.

The prior art coils cannot be effectively cleaned because the rods and wires within the ceramic cup are in direct contact with the concentrate. The prior art coils also are relatively short-lived and subject to damage due to the exposed location of the resistance wires and the overheating of the resistance wires as the concentrate boils away.

III. BRIEF DESCRIPTION OF THE INVENTION

The Invention is a coil for a personal vaporizer. The coil comprises a generally cylindrical cup that has sides, a base and an open top. The sides and base of the cup in cooperation define a cup interior volume. The cup interior volume is sized to accept an effective amount of a concentrate that a user may wish to vape.

The coil also comprises a housing. The housing has a housing open top and defines a housing internal volume. The housing defines a housing bottom side within the housing internal volume. The housing open top and interior volume are configured to receive and to retain the cup. The housing is configured to maintain the base of the cup in direct physical contact with a heating element that is trapped between the cup base and the housing bottom side.

The housing is composed of any material that is adequately workable and that has adequate structural strength, such as steel. The cup may be composed of any suitable material selected to not react with the concentrate and to have a coefficient of thermal expansion similar to that of the housing so that the housing and cup combination is stable when heated. Quartz glass or a ceramic is believed to be suitable for the cup material. Quartz glass is fused silica; namely, pure silica that is melted to form an amorphous solid. Quartz glass differs from conventional glass in that the quartz glass contains substantially no other ingredients. Quartz glass has a higher working temperature (about 1650 degrees C.) and melting temperature (about 2000 degrees C.) than conventional glass. The high strength and low thermal expansion of the quartz glass make it suitable for the application; however, any glass or ceramic material that is adequately strong, adequately stable at high temperatures and that has an adequately high working and melting temperature is suitable.

When a switch is closed, electrical current flows through the heating element, generating heat due to the resistance of the heating element and increasing the temperature of the heating element. The heating element heats the base of the cup by conduction due to the physical contact between the heating element and the base of the cup. The cup base conducts the heat to the concentrate contained within the cup, causing the concentrate to boil. The resulting vapor may condense to an aerosol. The aerosol and vapor are then inhaled by the user.

A coil cap is disposed on the open top of the housing and covers the housing open top and the cup open top. The coil cap may be selectably secured to the housing. A threaded connection between the coil cap and the coil housing has proven suitable in practice; however, any other mechanism to selectably attach the coil cap to the housing also is contemplated by the invention. For example, the coil cap may be secured to the housing by an interference fit between the coil cap and the housing, by a spring clip, by the weight of the coil cap, by a fastener, by an adhesive, or by any other suitable mechanism.

The coil cap may feature outlet holes communicating through the coil cap to allow aerosol and vapor from the boiling concentrate to be pulled from the coil by a person inhaling through a personal vaporizer. The coil cap also may feature inlet holes for make-up air to flow into the interior volume of the housing and of the cup as vapor and aerosol-laden air is pulled from the interior volume of the housing and cup by the user.

The configuration of the resistance heating element may be any that will suitably heat the cup from the bottom side. The resistance element may be a flat coil of wire. The flat coil of wire is attached to two electrodes in the form of lead wires that in turn are attached to the two poles of a battery. The wire of the flat coil can be of a uniform cross section along its length, which results in even heating of the wire.

The heated wire transfers heat to the base of the cup by conduction, since the heated wire is in direct contact with the base of the cup.

Any suitable shape may be used for the resistance element. For example, the resistance element may be in the form of a disk with electrodes attached to opposite edges of the disk. The disk may be composed of any suitable material, such as titanium. The disk-shaped heating element also is in direct physical contact with the base of the cup.

The disk-shaped heating element having electrical leads on opposing edges of the disk may include other features. A disk-shaped heating element does not present a current path of equal length for all possible routes of electrical current flowing from one electrical lead to the other. For a homogenous disk material of constant cross section, some paths through the disk will present a longer path and thus a higher electrical resistance than others. For most efficient operation and for even heating of the disk, the disk may be configured to present substantially equal resistance for each flow path by increasing the thickness of the portion of the cross section of the disk defining the longer flow paths and decreasing the thickness of the disk cross section defining shorter flow paths.

Alternatively, a thin disk of substantially constant cross section may effectively extend the life of the disk. When electrical potential is applied to opposing edges of the thin, homogeneous disk of substantially constant cross section, the principal electrical current flow path is directly between the two electrical leads, because any other path presents higher resistance. As the current flows through the disk, the portion of the disk between the two leads heats, which causes that portion of the disk to degrade over time and eventually to fail. As the portion of the disk between the electrical leads fails, its resistance increases. As the resistance of that portion of the disk increases, current will flow through another portion of the disk due to its relatively lower resistance. The disk therefore presents multiple redundant current flow paths and provides its own backup. As each current flow path degrades over time and eventually fails, the current will find another flow path through the disk.

Any other suitable heating element or heating technology may be used, for example, mica heating elements. Another alternative is coating the outside of all or a portion of the glass cup with an electrical conductor, such as a fluorine-doped tin oxide coating (SnO2:F). Resistance of the fluorine-doped tin oxide to current flowing between two electrical leads heats the coating and hence heats the glass cup.

The coil may feature an insulator between the heating element and the bottom side of the housing to reduce heat loss to the housing from the heating element. The insulating layer may be of any form known in the thermal insulating layer art that is capable of surviving the elevated temperatures of the heating element, that is adequately insulating, and that is adequately electrically non-conductive. For example, the insulating layer may take the form of silica fiber tiles, silica fiber felt, silica fiber cloth, meta-aramid (Nomex®) felt, or any other suitable material.

As an alternative or in addition to insulating layer, the coil may feature an air gap between the heating element and the bottom side of the housing to prevent heat conduction from the heating element to the bottom side of the housing. A spacer ring between the cup base and the housing bottom side may create the air gap. The spacer ring may include a spacer plate to support the heating element and to maintain the heating element in direct physical contact with the base of the cup. The spacer ring may be composed of any suitable material, such a conventional glass, quartz glass or ceramic. The heating element will heat the spacer plate by conduction. To prevent radiation loss from the spacer plate to the housing bottom side, the spacer plate or the bottom side of the housing or both may include a reflective surface, such as a layer or coating of a reflective metal.

Where the cup is retained in the housing by clips, the walls of the housing may define the clips. The clips may extend above the top edge of the housing or may be at any other height with respect to the walls of the housing. The wall of the housing that define clips also may be threaded for engagement with the coil cap.

IV. BRIEF DESCRIPTION OF THE DRAWINGS

V. DESCRIPTION OF AN EMBODIMENT

Figure 1:
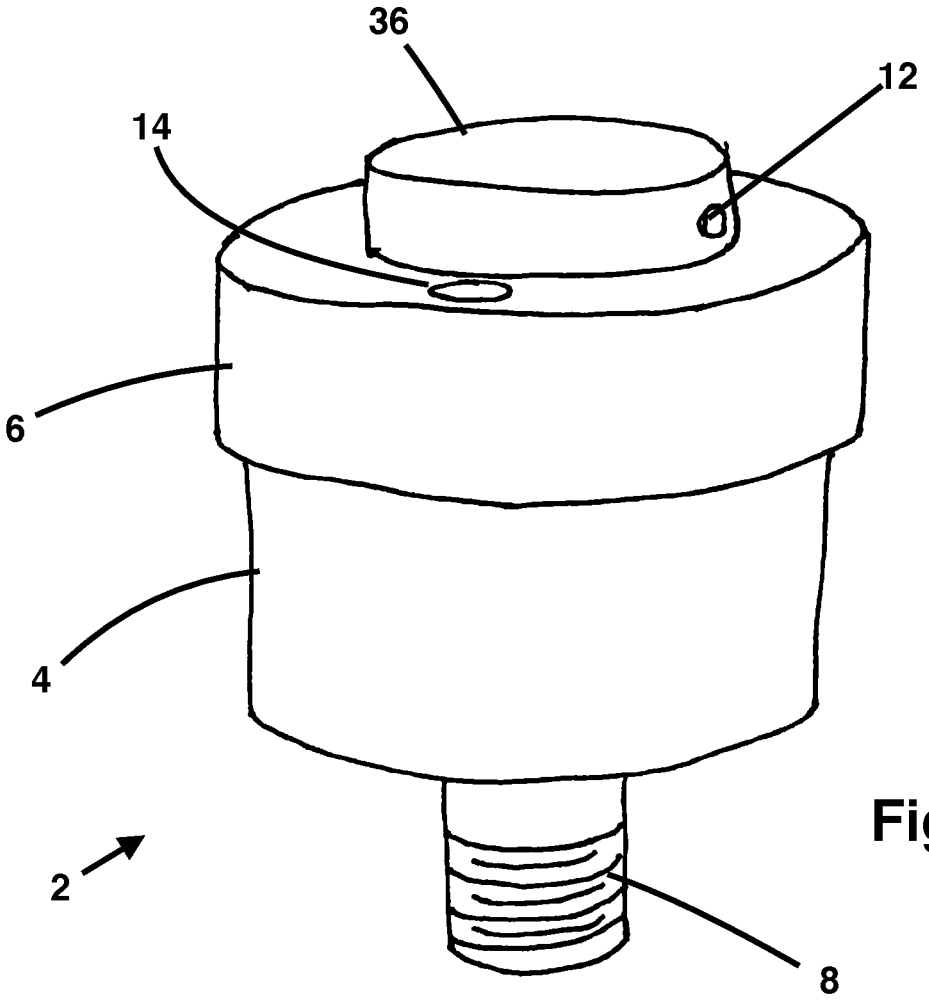
FIG. 1 is a perspective view of the coil and coil cap.

The coil 2 of the Invention is configured for attachment to a personal vaporizer. As shown by FIG. 1, the coil 2 of the Invention has a housing 4. A coil cap 6 is selectably attached to the housing 4. Mounting threads 8 allow the coil 2 to be selectably attached to a personal vaporizer.

Figure 2:
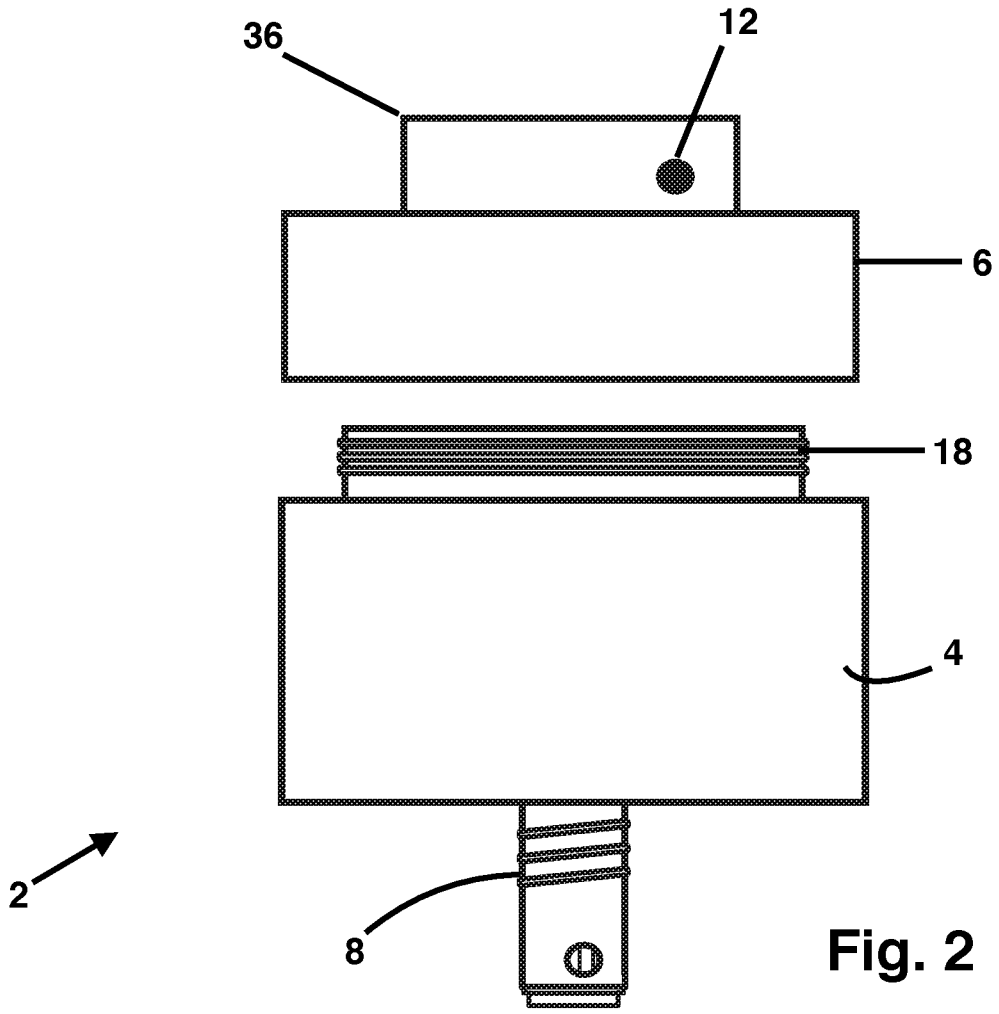
FIG. 2 is an exploded view of the housing and coil cap.
Figures 3, 4:
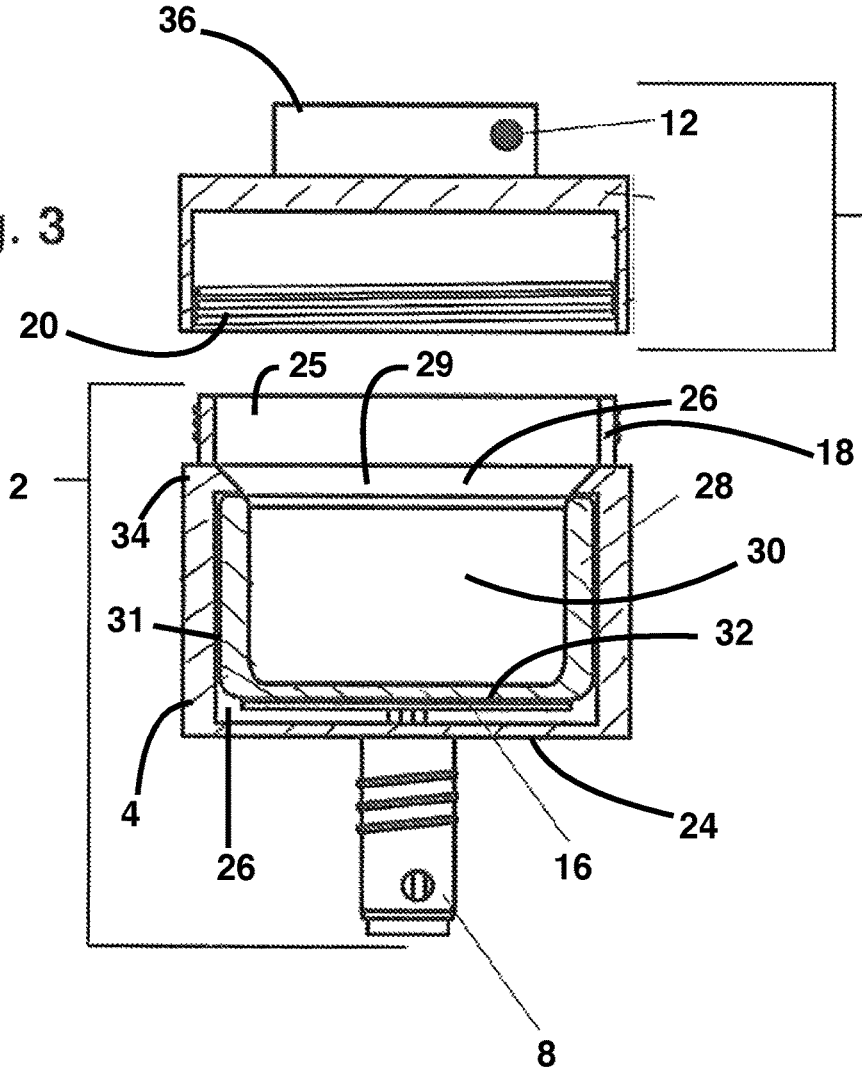
FIG. 3 is a section view of the coil cap.
FIG. 4 is a section view of a coil.

FIG. 2 is an exploded view of the housing 4 and coil cap 6. FIGS. 3 and 4 are section views of the coil 2 and coil cap 4. As shown by FIGS. 2, 3 and 4, the selectable attachment of the coil cap 6 to the coil 2 may be a threaded attachment. Female threads 20 in the coil cap 6 engage male threads 18 on the housing 4.

From FIG. 4, the housing 4 has housing walls 22 and a housing bottom side 24. The housing walls 22 and bottom side 24 in combination define a housing internal volume 26. Disposed within the housing internal volume 26 is a cup 28. The housing defines a housing open top 25 that receives the cup 28 and exposes the cup open top 29. The cup 28 may be composed of any suitable material, as described above, which may be glass or ceramic. Quartz glass is believed to be suitable for the cup 28. The cup 28 defines a cup interior volume 30 and a cup base 32. The cup interior volume 30 is configured to receive and retain an effective amount of a concentrate.

In the embodiment of FIG. 4, the housing 4 retains the cup 28 in the housing 4 using spring clips 34. Spring clips are discussed in more detail below with respect to FIG. 16. Spring clips 34 retain the outside surface of the cup 31 at the cup base 32 in direct physical contact with the heating element 16, so that heat moves from the heating element 16 to the cup 28 by conduction. In the embodiment of FIG. 4, the spring clips 34 trap the heating element 16 between the cup base 32 and the housing bottom side 24.

Figure 5:
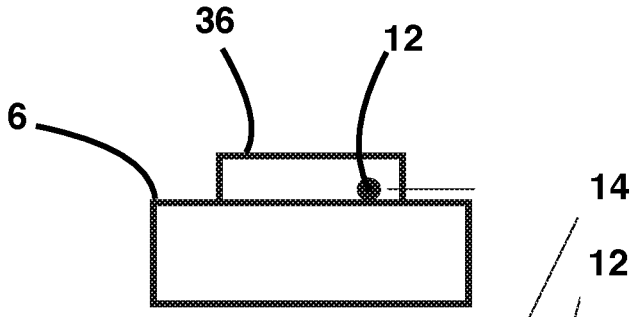
FIG. 5 is a side view of the coil cap.
Figure 6:
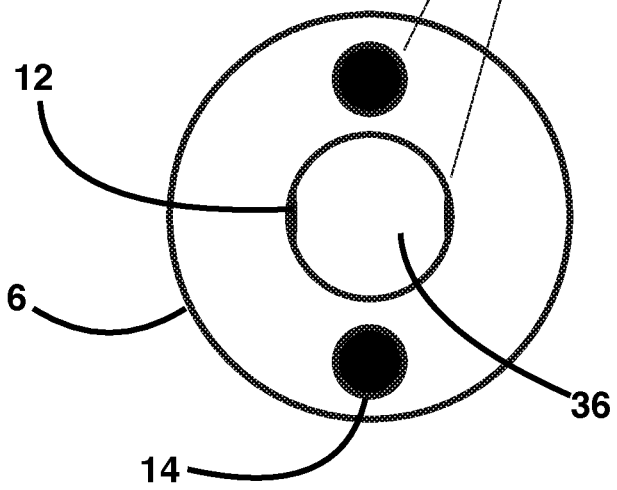
FIG. 6 is a top view of the coil cap.

FIGS. 5 and 6 are side and plan views of the coil cap 6. FIG. 5 shows an air outlet hole 12 in the chimney 36 of the coil cap 6. Air and vapor travels from the cup interior volume 30 through the pair of the air outlet holes 12 when the user inhales through the personal vaporizer. FIG. 6 shows the air inlet holes 14. Makeup air flows into the cup interior volume 30 air inlet holes 14 to replace the air and vapor drawn from the cup interior volume 30 by the user.

Figure 7:
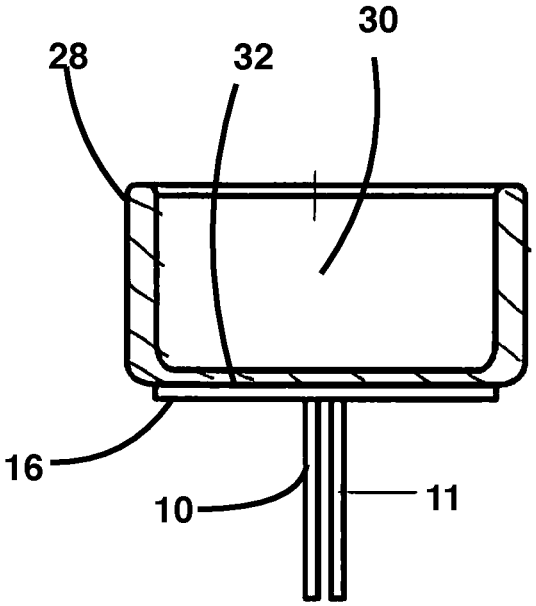
FIG. 7 is a detail sectional view of the cup and heating element.
Figure 8:
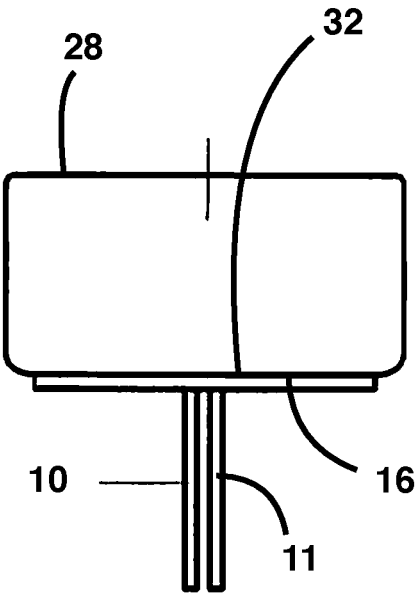
FIG. 8 is a side view of the cup and heating element.

FIG. 7 is a section side view of the cup 28 and heating element 16, with the first and second lead wire 10, 11. FIG. 8 is a side view of the cup 28 and heating element 16 of FIG. 7. As shown by FIGS. 7 and 8, the heating element 16 is on the outside of the cup interior volume 30 and is in direct physical contact with bottom side 32 of the cup 28. Electrical power flows to the heating element 16 through the first and second lead wires 10, 11.

Figure 9:
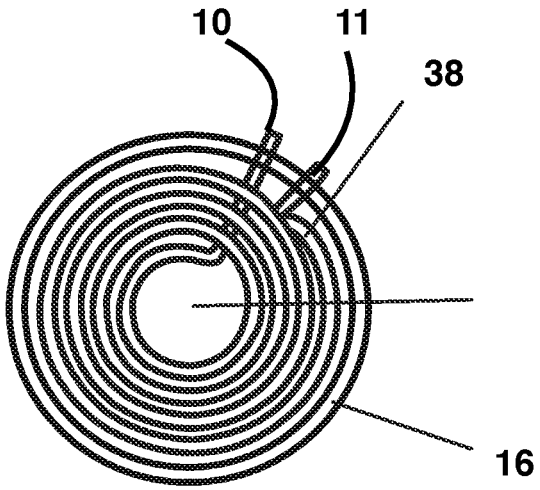
FIG. 9 is a plan view of a first heating element.
Figure 10:
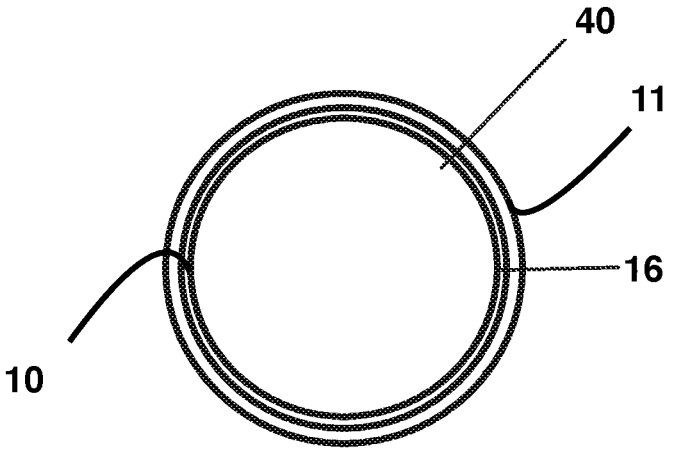
FIG. 10 is a plan view of a second heating element.

FIGS. 9 and 10 are plan views of different heating elements 16. The heating element 16 of FIG. 9 is a flat coil 38 of wire. The heating element 16 of FIG. 10 is a disk 40 with electrical leads 10, 11 attached to opposite edges of the disk. Electrical power flowing through the flat coil 38 of FIG. 9 or through the disk 40 of FIG. 10 causes the heating element 16 to heat, which in turn heats the cup 28 and the concentrate in the cup 28 by conduction. The disk heating element 40 of FIG. 10 is discussed further below with respect to FIGS. 17 and 18.

Figure 11:
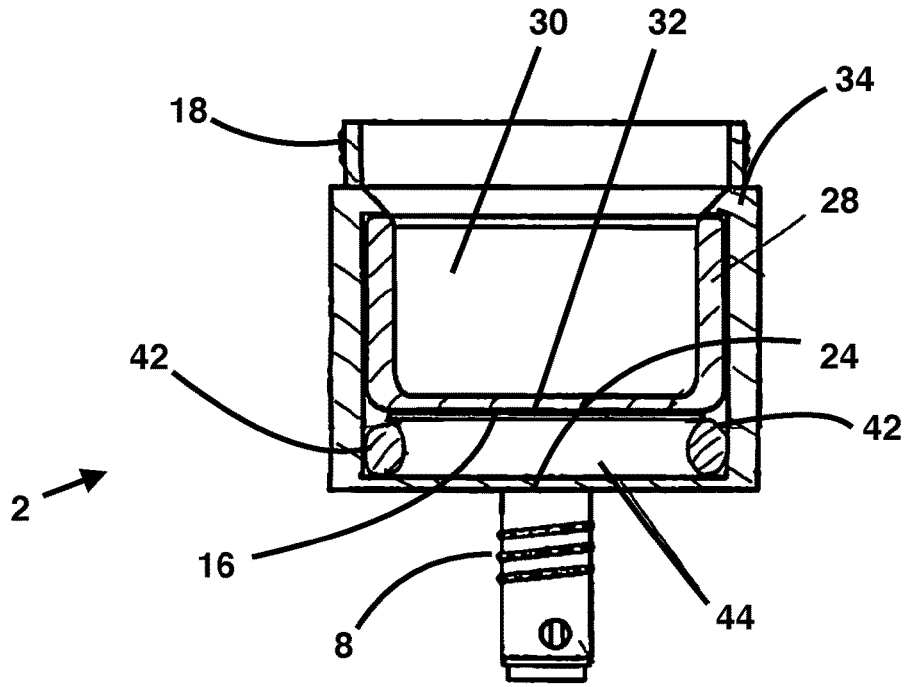
FIG. 11 is a section view of a coil having a spacer.

FIG. 11 is a sectional side view of an embodiment of the coil 2 that features a spacer ring 42 disposed between the heating element 16 and the housing bottom side 24. The spacer ring 42 serves to separate the heating element 16 from the housing bottom side 24 to create an air gap 44. The air gap 44 reduces the heat lost from the heating element 16 to the housing 4 by preventing losses by conduction. The spacer ring 42 is selected to have a relatively low thermal conductivity and may be composed of a ceramic or a glass similar to the cup 28. The heating element 16 still will lose heat to the housing bottom side by radiation. The radiation heat losses can be reduced by providing a reflective surface on the housing bottom side 24, on the heating element 16, or both.

Figure 12:
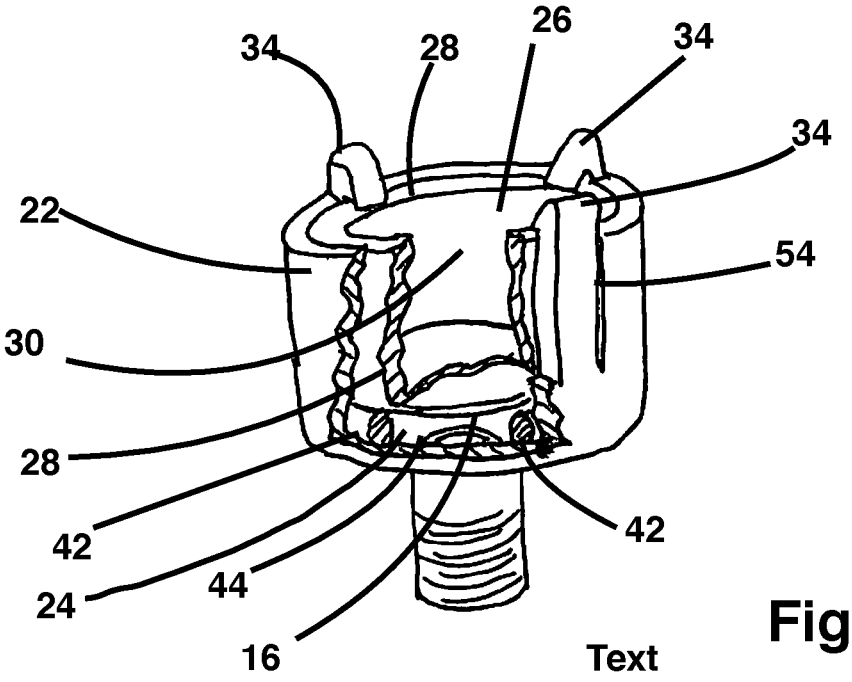
FIG. 12 is a detail cutaway view of a coil having a spacer.

FIG. 12 is a detail cutaway view of the coil 2 of FIG. 11. FIG. 12 shows the spacer ring 42 separating the heating element 16 from the housing bottom side 24 and creating air gap 44. FIG. 12 also shows the construction of the spring clips 34 retaining the cup 28 in the housing internal volume 26. That construction is discussed in more detail below with respect to FIG. 16.

Figure 13:
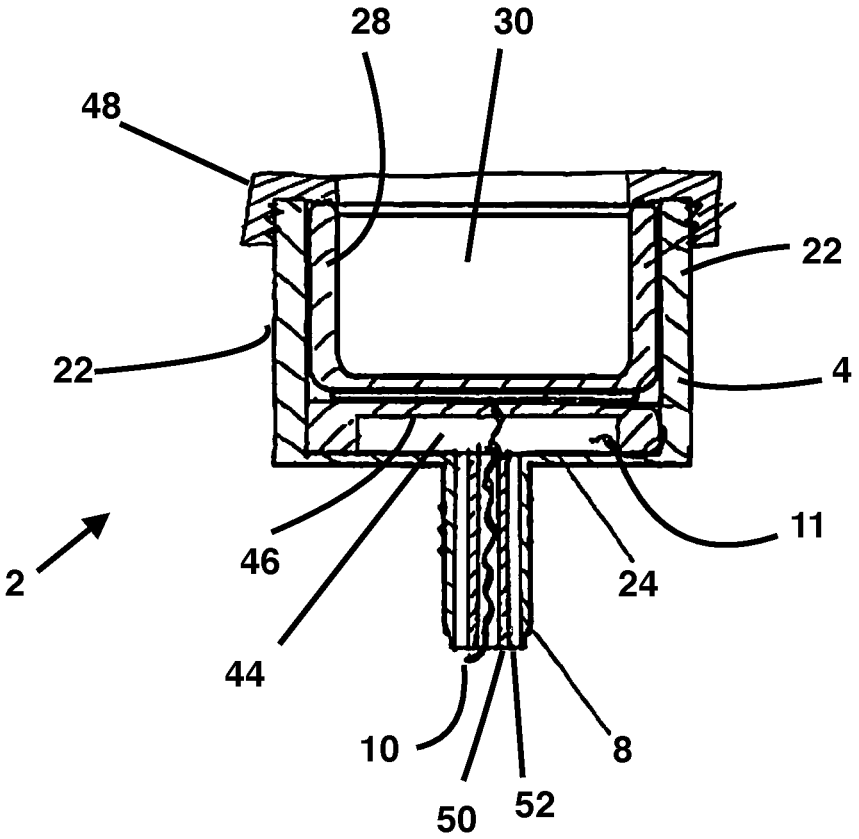
FIG. 13 is a section view of a coil having a spacer and spacer plate.

FIG. 13 is a cutaway side view of another embodiment. In the embodiment of FIG. 13, the heating element 16 is separated from the housing bottom side 24 by a spacer ring 42 having a spacer plate 46. The spacer plate 46 provides additional support to the heating element 16 to keep the heating element 16 in direct physical contact with the cup base 32. As for the embodiment of FIG. 12, the air gap 44 reduces heat conduction from the heating element 16 to the housing bottom side 24.

In the embodiment of FIG. 13, the cup 28, heating element 16 and spacer ring 42 with the spacer plate 46 are retained in the housing 4 by a threaded collar 48. The threaded collar 48 is in a threaded engagement with the housing 4, clamping the cup base 32 against the spacer ring 42, heating element 16 and cup base 32. Any suitable mechanism to retain the cup 28 in the housing 4 is contemplated by the Invention.

FIG. 13 also shows the first and second lead wires 10, 11. The second lead wire 11 contacts the conductive housing 4, allowing current to flow from the second lead 11 through the housing 4. The first lead 10 passes through a channel 50. The hollow cylinder of the channel 50 is conductive and is insulated from the housing 4 by insulator 52. When the mounting threads 8 are connected to the power supply of a personal vaporizer, the channel 50 and first wire lead 10 are electrically connected to one pole of the power supply and the second wire lead 11 and the housing 4 are electrically connected to the other pole of the power supply, allowing current to selectably flow through the heating element 16.

Figure 14:
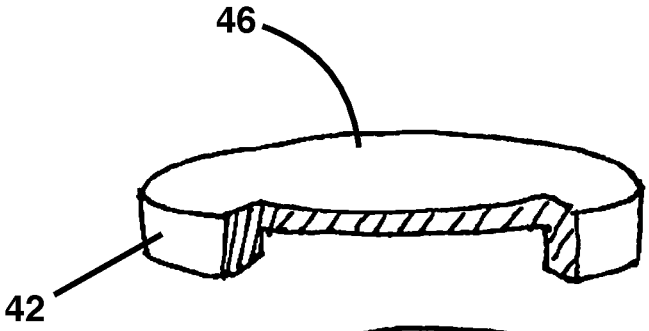
FIG. 14 is a detail cutaway view of a spacer having a spacer plate.
Figure 15:
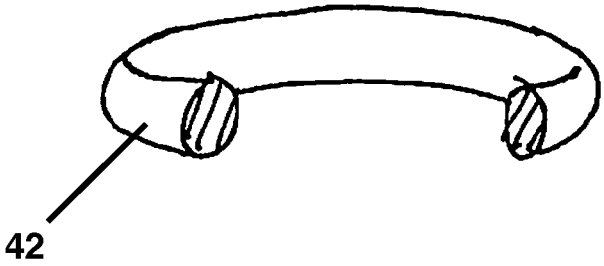
FIG. 15 is a detail cutaway view of a spacer without a spacer plate.

FIG. 14 is a detail cutaway view of a spacer ring 42 having a spacer plate 46, which is shown in context in FIG. 13. FIG. 15 is a detail cutaway view of the spacer ring 42 shown in context in FIGS. 11 and 12.

Figure 16:
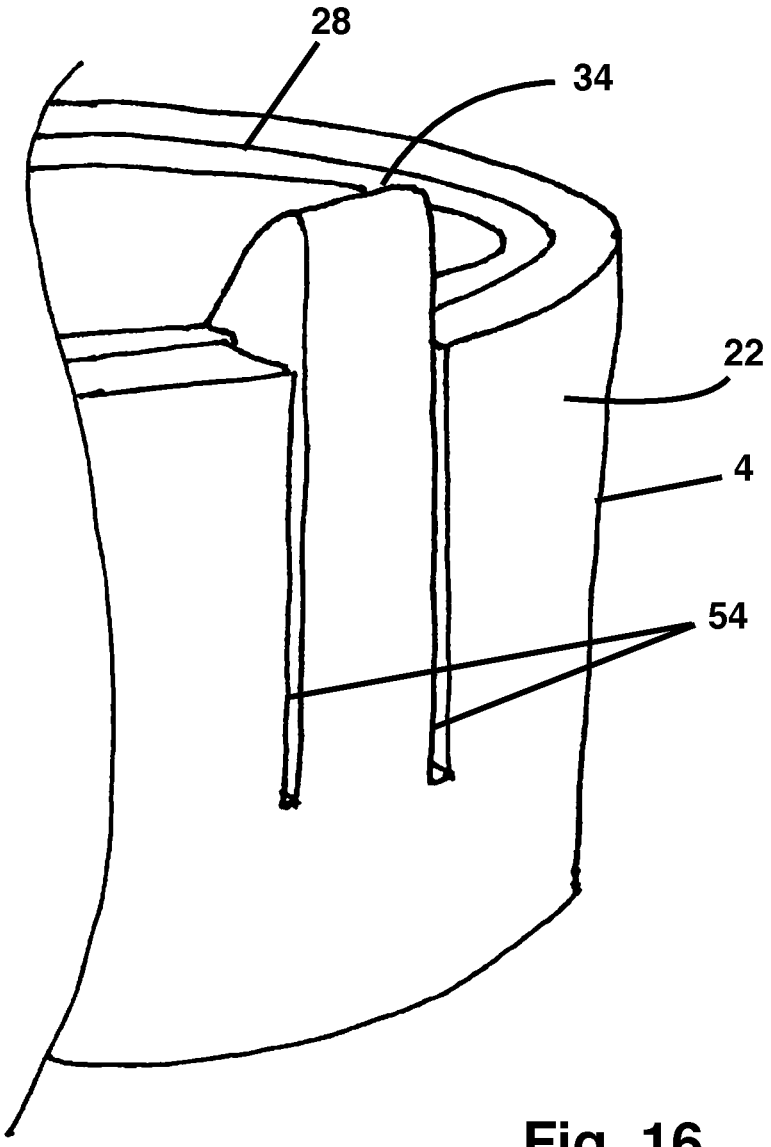
FIG. 16 is a detail perspective view of a housing with a clip.

FIG. 16 is a detail perspective view of a spring clip 34 defined by the housing wall 22. Slots 54 allow the spring clip 34 to move laterally. To install the components of the coil 2 in the housing 4, the spring clips 34 are moved outward and the components inserted into the housing internal volume 26. The spring clips 34 then return to their original position, retaining the cup 28, heating element 16, and any spacer ring 42 or spacer plate 46.

Figure 17:
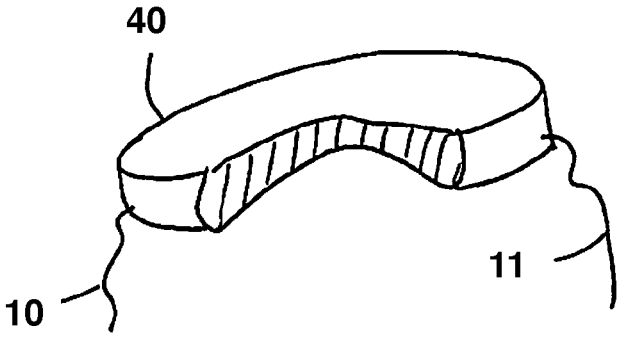
FIG. 17 is a detail cutaway view of a disk-shaped heating element having unequal thickness and substantially constant resistance for all current flow paths.
Figure 18:
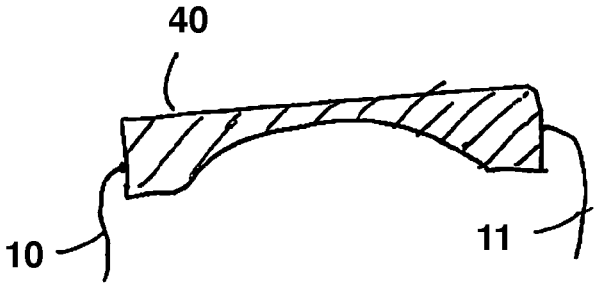
FIG. 18 is a section view of the disk of FIG. 17.

FIG. 17 is a detail cutaway of one embodiment of the disk heating element 40. FIG. 18 is a section view of the same embodiment as FIG. 17. FIGS. 17 and 18 illustrate a disk heating element 40 that is configured to have substantially constant current flow through all portions of the disk 40. The disk 40 is configured to be thinner in cross section along the shortest current path directly between the two wire leads 10, 11 and thicker for alternative current paths further from the shortest path between the two leads 10, 11. Other configurations for the disk heating element 40 are contemplated by the Invention. The disk heating element 40 may be of constant thickness and may have any other configuration known in the art.

Figure 19:
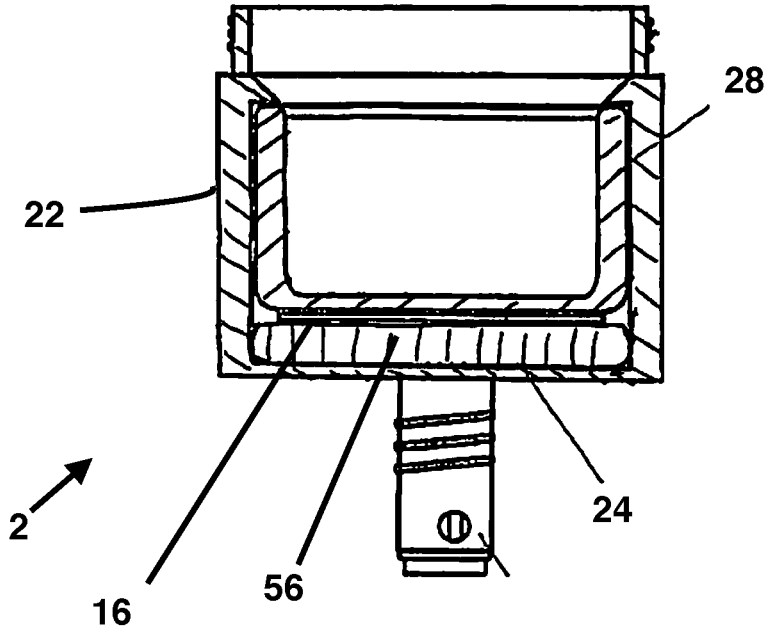
FIG. 19 is a partial cross section of the coil with insulating layer.

FIG. 19 is a partial cross section of the coil 2 featuring insulating layer 56 disposed between the heating element 16 and the housing bottom side 24. The insulating layer 56 slows heat transfer between the heating element 16 and the housing 4. The insulating layer 56 may be used in addition to or instead of the air gap 44 illustrated by FIGS. 11, 12 and 13. The insulating layer 56 may be composed of any material that is capable of withstanding the temperatures generated by the heating element 16 and that has an adequately low thermal conductivity to prevent excessive heat transfer to the housing 22.

LIST OF NUMBERED ELEMENTS

The following numbered elements are identified in the drawings and discussed in the specification.

2 coil
4 housing
6 coil cap
8 mounting threads
10 electrode or first lead wire
11 electrode or second lead wire
12 air outlet holes
14 air inlet holes

16 heating element
18 male threads on the housing
20 female threads on the coil cap
22 housing walls
24 housing bottom side
25 housing open top
26 housing internal volume
28 cup
29 cup open top
30 cup interior volume
31 cup outside surface
32 cup base
34 spring clips
36 chimney
38 flat coil heating element
40 disk heating element
42 spacer ring
44 air gap
46 spacer plate
48 threaded collar
50 channel
52 insulator
54 slots
56 insulating layer

I claim:

1. A coil for a personal vaporizer for vaping by a user, the coil comprising:

a. a cup having an interior volume, said interior volume being configured to receive a concentrate to be vaporized in the personal vaporizer, said cup defines an outside surface, said outside surface not being disposed within said cup interior volume, said cup is generally cylindrical and defines a cup base and a cup open top;

b. a heating element configured to heat said concentrate within said cup interior volume, said heating element not being disposed within said interior volume when said heating element is heating said liquid, said heating element is in direct contact with said cup outside surface when said heating element is heating said concentrate;

c. a housing, said housing defining a housing open top, a housing internal volume, and a housing bottom side within said housing internal volume, said housing internal volume being configured to receive said cup within said housing internal volume, said heating element being disposed between said cup base and said housing bottom side, said housing being configured to maintain said heating element in direct physical contact with said cup base;

d. a coil cap, said coil cap being selectably attachable to said housing, said coil cap being configured to cover said housing open top and said cup open top when said coil cap is attached to said housing, said coil cap defines an outlet hole and an inlet hole, said outlet and inlet holes communicating through said coil cap, said outlet hole being configured to allow a vapor from said heated concentrate to be pulled from the coil by a person inhaling through the personal vaporizer, said inlet hole being configured to allow a makeup air to enter the coil.

2. The coil of claim 1 wherein said cup is composed of quartz glass.

3. The coil of claim 1 wherein said heating element is a resistance heating wire.

4. The coil of claim 1 wherein said heating element is a flat coil of resistance heating wire having a substantially uniform cross section along its length.

5. The coil of claim 1 wherein said heating element is in a shape of a disk having electrodes electrically connected to opposing sides of said disk.

6. The coil of claim 5 wherein said disk defines a plurality of flow paths for electricity between said electrodes, each location on said disk corresponding to a one of said plurality of flow paths, each said location having a thickness, said thickness of each said location depending upon a length of said flow path corresponding to said location, whereby each of said plurality of flow paths between said electrodes presents a substantially equal electrical resistance to each other of said flow paths.

7. The coil of claim 5 wherein said disk defines a plurality of flow paths for electricity between said electrodes, each location on said disk corresponding to a one of said plurality of flow paths, each said location having a thickness, said thickness being substantially constant for each said location on said disk, whereby an electrical resistance for at least two of said plurality of flow paths for electricity between said electrodes is substantially unequal.

8. The coil of claim 1 wherein said housing has a configuration to retain said cup in said housing internal volume, said configuration comprising: a clip defined by said housing, said clip being configured to engage said cup.

9. The coil of claim 1 wherein said cap is in a selectable threaded engagement with said housing.

10. A coil for a personal vaporizer for vaping by a user, the coil comprising:

a. a cup having an interior volume, said interior volume being configured to receive a concentrate to be vaporized in the personal vaporizer, said cup defines an outside surface, said outside surface not being disposed within said cup interior volume, said cup is generally cylindrical and defines a cup base and a cup open top;

b. a heating element having a top side and a bottom side and defining a thickness between said top and bottom sides, said heating element defining a diameter, said diameter being greater than said thickness, said heating element being configured to heat said concentrate within said cup interior volume, said heating element not being disposed within said interior volume when said heating element is heating said liquid, said top side of said heating element is in direct contact with said cup outside surface when said heating element is heating said concentrate;

c. a housing, said housing defining a housing open top, a housing internal volume, and a housing bottom side within said housing internal volume, said housing internal volume being configured to receive said cup within said housing internal volume, said heating element being disposed between said cup base and said housing bottom side, said housing being configured to maintain said heating element in direct physical contact with said cup base;

d. a spacer ring, the spacer ring being disposed about a periphery of said housing bottom side, said spacer ring separating said housing bottom side and said heating element bottom side wherein an insulating layer is disposed between said heating element and said housing bottom side, said insulating layer being configured to slow a transfer of heat from said heating element to said housing bottom side.

11. The coil of claim 10 wherein said insulating layer comprising: an air gap between said heating element and said housing bottom side.

12. The coil of claim 10, the coil further comprising: a spacer plate, said spacer plate being disposed between said spacer ring and said heating element, said spacer plate being configured to maintain said heating element in direct contact with said cup base.

13. The coil of claim 12 wherein said spacer plate or said bottom side of said housing includes a reflective surface, whereby radiation of heat from said spacer plate to said bottom side of said housing is reduced.

* * * * *